US005510884A

United States Patent [19]

Bov, Jr. et al.

[11] Patent Number: 5,510,884

[45] Date of Patent: Apr. 23, 1996

[54] SUPPLY ACCESSORY FOR A PRINTING MACHINE WITH HIDDEN IDENTIFIER

[75] Inventors: Raphael F. Bov, Jr., Pittsford; Jose R. Diaz, Rochester; Thomas L. Edelman, Marion; Michael J. McVeigh, Webster; Ana S. Nolau, Rochester; Martin J. Curynski, Williamson; Cindy L. Casper, Marion; Richard D. Szczepanski, Rochester, all of N.Y.

[73] Assignee: Xerox Corporation, Stamford, Conn.

[21] Appl. No.: 409,245

[22] Filed: Mar. 24, 1995

[51] Int. Cl.[6] ..... G03G 15/06

[52] U.S. Cl. ..... 355/260; 355/200; 355/210; 222/DIG. 1

[58] Field of Search ..... 355/260, 210, 355/200, 201; 222/DIG. 1

[56] References Cited

U.S. PATENT DOCUMENTS

| | | | |
|---|---|---|---|
| 4,611,730 | 9/1986 | Ikesue et al. | 222/167 |
| 4,870,463 | 9/1989 | Miyoshi et al. | 118/653 |
| 4,873,549 | 10/1989 | Tada et al. | 355/260 X |
| 4,961,088 | 10/1990 | Gilliland et al. | 355/260 X |
| 5,021,828 | 6/1991 | Yamaguchi et al. | 355/209 |
| 5,138,373 | 8/1992 | Hoyer | 355/200 |
| 5,177,529 | 1/1993 | Scholl et al. | 355/200 |
| 5,208,631 | 5/1993 | Jacobs et al. | 355/260 X |
| 5,220,385 | 6/1993 | Surti | 355/260 |
| 5,235,351 | 8/1993 | Koizumi | 346/140 R |
| 5,289,242 | 2/1994 | Christensen et al. | 355/260 |

FOREIGN PATENT DOCUMENTS

| | | | |
|---|---|---|---|
| 61-41159 | 2/1986 | Japan | 355/260 |
| 2-72381 | 3/1990 | Japan | 355/260 |
| 2-73264 | 3/1990 | Japan | 355/260 |

*Primary Examiner*—Matthew S. Smith
*Attorney, Agent, or Firm*—R. Hutter

[57] ABSTRACT

A customer-replaceable supply accessory for a page printer, such as a toner cartridge or liquid-ink supply, includes a conductor which interacts with connectors within the printer to ensure proper installation of a given type of accessory. The conductor is exposed only within cavities on the accessory which receive springably-mounted extendible members. The extendible members serve to secure the accessory in position within the printer. The conductor is generally not apparent from the outside of the accessory.

18 Claims, 3 Drawing Sheets

SUPPLY ACCESSORY FOR A PRINTING MACHINE WITH HIDDEN IDENTIFIER

The present invention relates to supply accessories, such as toner or developer cartridges, or liquid ink cartridges, which are installable in a printing apparatus. In particular, the present invention relates to a system by which a printing apparatus may detect the particular capabilities of a supply accessory installed therein.

Page printers such as commonly found in offices typically use either a dry toner powder to develop a desired image on a photoreceptor, or else use a liquid ink ejectable in imagewise fashion directly on a sheet. Dry toner powder or liquid ink is typically contained in a replaceable unit which may be installed and removed by the end user. Such cartridges may also include other hardware for dispensing the dry toner or liquid ink, such as, in the case of electrophotographic printing, a donor roll and photoreceptor, and in the ink-jet case, an ink-jet printhead. Such cartridges, which shall be generally referred to herein as a "supply accessories" containing "print material" such as dry toner or liquid ink, are designed to operate in a given printing apparatus having sensors or mechanical switches therein which allow the internal software of the printing apparatus to determine if the supply accessory has been properly installed before printing.

Particularly in the case of magnetic ink character recognition (MICR) printers, which are often used to print negotiable instruments such as checks, there is an inevitable danger that the apparatus may be used to print fraudulent or otherwise unauthorized valuable documents. In order to print a usable check, a user must have access not only to the MICR fonts which are readable by MICR reading apparatus, but also magnetic-based print material, such as MICR toner, in order to form the desired magnetic characters. There is thus a security premium placed on physical access to a page printer which is capable of creating documents with magnetic print material. Simultaneously, there has been a demand in the marketplace for readily manufacturable MICR printers, which could be provided in a highly distributed environment, such as at individual bank branches or at insurance offices, for on-the-spot printing of checks. Therefore, it is desirable to maintain a balance between security and the capability of readily-available desk-top printers, such as the "printers" found in many offices, while still preventing abuse.

U.S. Pat. No. 4,611,730 discloses a supply cartridge for an electrophotographic printer, provided with a mating member which corresponds in position to a mating member in the holder inside the printing machine. The mating member is configured so only a cartridge having this first mating member may be properly held in the holder for installation in the printing apparatus.

U.S. Pat. No. 4,870,463 discloses a toner cartridge including a loading flange which correspond to shoulder surfaces inside the apparatus, and a closing member extending above and surrounding the loading flange. The closing member is formed of a flexible material such as sponge rubber.

U.S. Pat. No. 5,021,828 discloses a toner cartridge having devices which measure the lifetime of the toner cartridge. Different consumable parts within the toner cartridge include an indication of what stage of consumption or state within its life-time that it has reached.

U.S. Pat. No. 5,220,385 discloses a "cartridge" for a printing apparatus, the cartridge having control means therein which is actually responsive to insertion of the cartridge in a printing apparatus.

U.S. Pat. No. 5,235,351 discloses various designs of an ink-jet printhead, installable in a ink-jet printing apparatus, having various structures therein which can be used to detect symbolic information relating to the characteristics of the printhead. At FIG. 9A thereof, there is disclosed various indentations in the printhead which can be detected by mechanical levers, and, at FIG. 10 thereof, there is disclosed a conductive trace which can activate a subset of contacts within the printing apparatus; the particular subset of contacts that are activated by the conductive tray can be representative of symbolic data relating to the printhead.

U.S. Pat. No. 5,289,242 discloses a method and system for indicating a type of toner print cartridge which has been loaded into a printer. One type of print cartridge includes a conductive strip on the outside surface thereof, which mates with a pair of electrical contacts within the printer housing when a lid or cover carrying the print cartridge is closed into the printer housing.

According to one aspect of the present invention, there is provided a supply accessory installable in a printing apparatus, comprising an outer housing, and a tank, disposed at least partially within the outer housing, adapted to retain a supply of print material. A first cavity and a second cavity are defined in an outer surface of the outer housing. A first conductive surface is disposed within the first cavity and a second conductive surface disposed within the second cavity. A conductor is disposed inside the outer housing between the first conductive surface and the second conductive surface.

According to another aspect of the present invention, there is provided a supply accessory installable in a printing apparatus, comprising an outer housing, and a tank, disposed at least partially within the outer housing, adapted to retain a supply of print material. A first conductive surface and a second conductive surface are disposed on the housing. A conductor is operatively disposed between the first conductive surface and the second conductive surface, the conductor being not exposed on an outer surface of the outer housing.

According to another aspect of the present invention, there is provided a printing apparatus, comprising a supply accessory including an outer housing, and a tank, disposed at least partially within the outer housing, adapted to retain a supply of print material. A first cavity and a second cavity are defined in an outer surface of the outer housing. A first conductive surface is disposed within the first cavity and a second conductive surface disposed within the second cavity. A conductor is disposed inside the outer housing between the first conductive surface and the second conductive surface. An extendible member is positioned within the printing apparatus to extend into the cavity defined in the outer surface of the outer housing when the supply accessory is installed.

Figure 3:
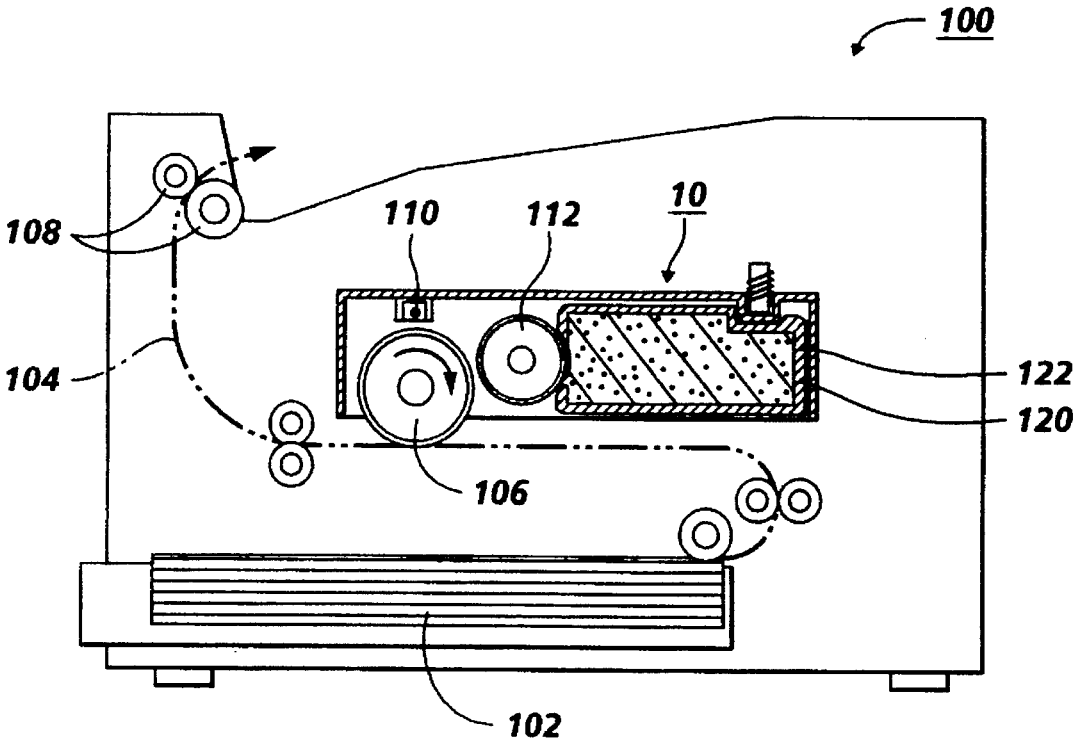
FIG. 3 is a sectional elevational view of a representative electrophotographic printer, using a supply accessory according to the present invention.

FIG. 3 shows a representative design of a desk-top page printer, such as an electrophotographic "printer," which would use the supply accessory according to the present invention. The printing apparatus, generally indicated as 100, includes a supply stack 102 from which individual blank sheets, such as of paper, are drawn as they are desired for the creation of an image thereon. The drawn sheet from stack 102 is caused to move, by a set of rollers (not shown) through a paper path generally indicated as 104. At one station along paper path 104 the sheet comes in contact with a photoreceptor generally indicated as 106, which is here in the form of a rotating drum. A quantity of print material, such as toner, is formed in imagewise fashion on the surface of photoreceptor 106 and is caused to transfer to the sheet by means such as a transfer corotron (not shown), as would be familiar in the art of electrophotography. After the imagewise toner is transferred to the sheet, the sheet is then moved along paper path 104 through fusing rolls 108, which causes the imagewise toner on the sheet to be permanently fixed, or fused, onto the sheet to form a permanent image. Once the fused sheet is passed through fusing rolls 108, the sheet is unloaded onto a paper tray, such as at the top of the printing apparatus, where several sheets can be made to accumulate.

As is known in the art of electrophotographic printing, the toner image formed on photoreceptor 106 is typically formed by first charging the photoreceptor surface with a uniform charge, such as by corotron 110, and then selectably discharging the charged surface by means such as a raster output scanner or LED bar (not shown) to discharge those areas which are intended to print white in the desired image. After the particular portion of the image is discharged, a latent image of charged areas in the print-black portions of the image is developed by the application of printer material, such as toner, on the charged surface of photoreceptor 106. Typically, this development is performed by a development system, of any number of designs known in the art, typically including at least a donor roll 112, which rotates in parallel to the photoreceptor 106 and carries toner particles on the outside thereof, such as by magnetic means. The toner particles uniformly distributed on the surface of donor roll 112 are brought into close proximity with the latent image formed on photoreceptor 106, whereupon toner particles are attracted only to the charged areas on the image formed on photoreceptor 106.

The ultimate source of fresh toner particles for conveyance on donor roll 112 is a toner supply, here indicated as 120. The toner supply 120, which may or may not contain an admixture of carrier particles as is known in the art, is retained within a tank 122. Toner particles are drawn from the toner supply 120 in tank 122 and distributed evenly on the donor roll 112 to be made available to the photoreceptor 106.

It is clear that the supply of toner 120 within tank 122 will eventually run out in the course of printing a large number of sheets, and therefore the toner supply 120 must be replenished. It is common in the art of desk-top printing apparatus to provide a customer-replaceable unit which includes a fresh supply of toner 120. It is also fairly common in the art to supply within the customer-replaceable unit other parts which are known to wear out over time, such as donor roll 112 and even photoreceptor 106, along with any other associated hardware. In an ink-jet printer, the print material is liquid ink and the customer-replaceable unit may further include an ink-jet printhead and associated circuitry. (It will also be apparent that, although an electrophotographic digital printer is shown in FIG. 3, the representative parts shown therein are also found in a light-lens copier, and, for purposes of the claims herein, a copier shall be considered a type of printing apparatus.) As shown in FIG. 3, this customer-replaceable unit is generally indicated as supply accessory 10.

Figure 1:
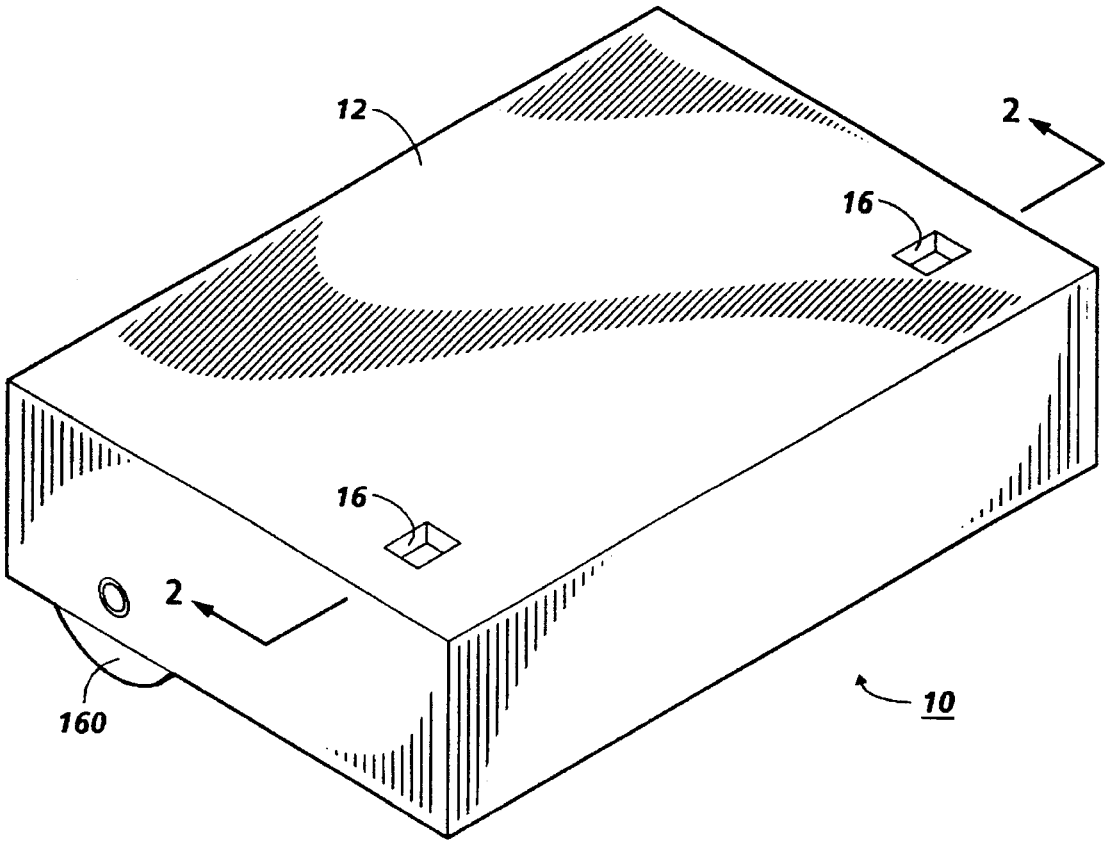
FIG. 1 PRIOR ART
FIG. 1 is a perspective view of one embodiment if a supply accessory according to the present invention.

FIG. 1 is a perspective view showing the exterior of a supply accessory 10 usable in conjunction with the present invention. There is shown in FIG. 1 a portion of a photoreceptor drum 106, but this is not directly necessary to the present invention. A supply accessory 10 typically includes a tank adapted to retain a supply of what can be generally called "print material," such as electrophotographic toner, or liquid ink for use in an ink-jet-based printing apparatus. The supply accessory 10 includes an outer housing 12, which may or may not completely encompass all of the hardware included in the supply accessory 10. There is formed on outer housing 12, on an outer surface thereof, two cavities 16. These cavities 16 are relatively small indentations in the housing 12, which facilitate proper placement of the supply accessory 10 within a larger printing apparatus. Springably-mounted extendible members in the printing apparatus may be urged therein, thereby securing the supply accessory 10 in its proper place relative to a paper path within the printing apparatus.

If security considerations are important with the printing apparatus, such as if the printing apparatus dispenses magnetic-based printing material for the creation of MICR images, it is desirable to provide any number of security means to regulate the production of such documents. At the same time, it would be useful to provide the same general apparatus for printing secure documents as any other type of document. It may be desirable that the only difference between a MICR printer and a conventional printer be that the MICR printer includes a supply accessory having magnetic-based print material. Therefore, a supply accessory dispensing magnetic-based print material should be as far as possible indistinguishable from a conventional type of supply accessory, but there must be some additional security means provided in the supply accessory.

Cavities 16, which accept springably-mounted extendible members within the printing apparatus to secure the position thereof, are known in the prior art. According to the present invention, these cavities 16 can further be exploited to provide a security device which would not be at least immediately apparent to a potential fraudulent user of such a supply accessory.

Figure 2:
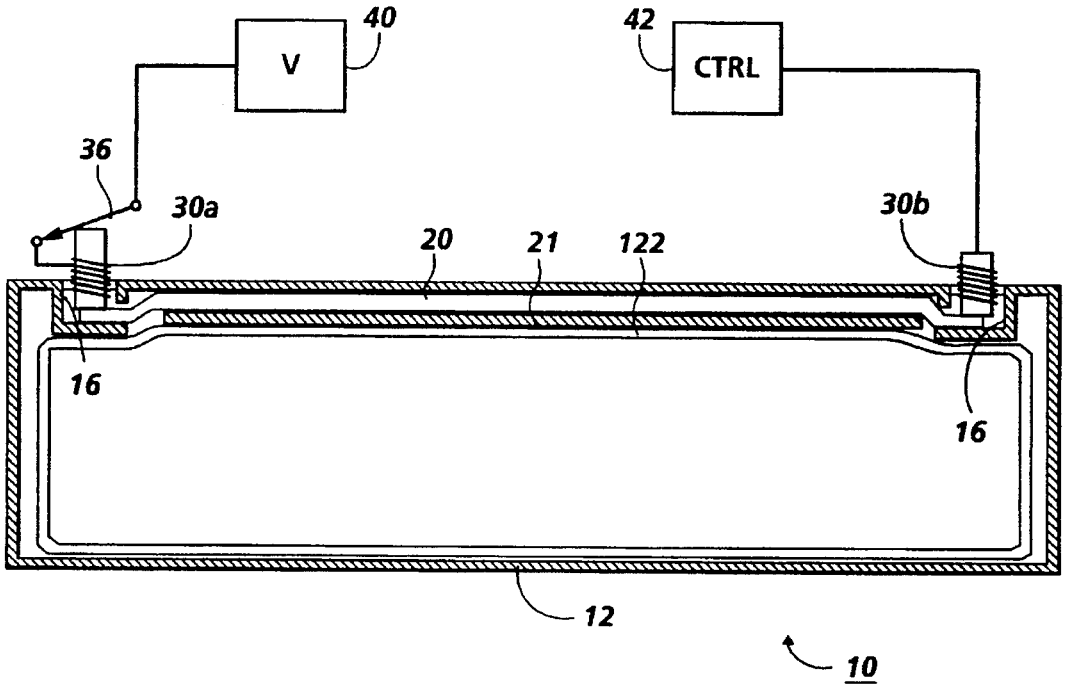
FIG. 2 is a cross-sectional view through the supply accessory shown in FIG. 1, through lines 2—2 thereof, in combination with other hardware within a printing apparatus.

FIG. 2 is a cross-sectional view through the supply accessory 10 shown in FIG. 1, along the lines marked 2—2 in FIG. 1, in combination with hardware in a printing apparatus interacting with the supply accessory. There can be seen, in this cross-section, the outer housing 12 of supply accessory 10, and a section through the tank 122 which is adapted to retain a supply of print material such as toner or liquid ink. As used in the claims herein, a "tank" shall refer to any chamber for retaining a supply of print material; the tank can be effectively made integral with the outer housing.

There can be seen in FIG. 2 a conductor bar indicated as 20, which extends from one cavity 16 to the other cavity 16, with a conductive surface of the conductor bar 20 being exposed within each cavity 16. However, significantly, the portion of conductor bar 20 extending between the two cavities 16 is diposed within the outer housing 12, and is not apparent from the outside of the supply accessory 10.

In FIG. 2, the supply accessory 10 is shown in combination with two extendible members **30*a* and 30*b*, fixedly mounted within the printing apparatus, which are each insertable into one cavity 16. These extendible members 30*a*, 30*b*, preferably serve to secure the supply accessory 10 within the printing apparatus by urging the whole supply accessory 10 into a proper position relative to the paper path. However, these extendible members 30*a*, 30*b*, can be made to serve as conductive members, which could contact exposed surfaces of the conductor bar 20 in either cavity 16. Thus, an electrical connection can be formed between the extendible members 30***a*, 30*b*, through conductor bar 20. Further, the extendible members 30*a*, 30*b*, can be activated with direct current in an inconspicuous manner, so that the interaction between the extendible members 30*a* and 30*b* with conductor bar 20 can serve as a "secret" security check on the use of the supply accessory.

As shown by voltage source 40 and control system 42, which are intended to be disposed within a printing apparatus, the fact that there is conduction between extendible member 30*a* and 30*b* through conductor bar 20 can be used to enable, prevent, or otherwise affect the operation of the printing apparatus. For example, if a manufacturer makes MICR and non-MICR versions of the same supply accessory 10, one version could be provided with a conductor bar 20, while the other version would have no such conductor bar. In this way, for example, a security system within the printing apparatus would be able to detect whether a MICR supply accessory is being used and, for example, require a password to be entered by a user of the printer apparatus. If a supply accessory lacking the conductor bar 20 is used, to continue this example, then no such security procedure would be required. It may also be desirable to alert an authorized user that the printer is not loaded with a MICR cartridge. Of course, any number of security routine variations could be contemplated using the supply accessory having a conductor bar 20.

A springably-mounted extendible member such as 30*a* can be mechanically operatively connected to a switch 36, which can be designed to either open or close a connection between voltage source 40 and control system 42 when the extendible member 30*a* is extended a given extent or distance into cavity 16. Whether a switch 36 is designed to be open or closed when its associated extendible member 30*a* is extended into cavity 16 can form another dimension of security in addition of the presence of conductor bar 20. For example, it may be made significant, in a security procedure, that conductor bar 20 must be present in the supply accessory 10, and that the extendible member 30*a* extend a particular predetermined distance into a cavity 16 in order to position switch 36. Indeed, there may be provided additional cavities 16, all or some of which are connected by a conductor bar such as 20, in order to provide further security or cartridge-identification systems, such as for different color print materials.

Another variation to the present invention is to provide a system which would be sensitive to specific, nonzero predetermined resistances of conductor bar 20. For example, as part of an enhanced security system, it may be desirable that control system 42 not only receive current through conductor bar 20, but that the current received be consistent with conductor bar 20 having a resistance of five ohms, with any other value of current indicating that an unauthorized cartridge 10 had been inserted. Alternately, control system 42 could be designed to recognize different possible predetermined resistances in conductor bar 20 as relating to different types of cartridges: for example, five ohms could indicate MICR toner, ten ohms could indicate red toner, etc.

A key point of novelty of the claimed invention, in view of prior art systems, is that the conductor bar 20 would not be immediately apparent to an end user as part of a security system. Because the cavities 16, in a preferred embodiment of the invention, are used to mechanically position the supply accessory 10 within a printing apparatus, it would not be apparent to an end user that any metal surfaces within such a cavity 16 would have any security significance. The fact that the conductor bar 20 is substantially hidden from view also adds a measure of security. Such an arrangement is in contrast to, for example, the systems shown in U.S. Pat. No. 5,235,351 or U.S. Pat. No. 5,289,242, in which the data relating to the performance of the supply accessory or printhead is in the form of a conductive trace on the outside surface of the accessory, and wherein no attempt is made to obscure the interaction of this conductive trace with contacts within the printing apparatus. According to a preferred embodiment of the invention, the extendible members 30*a*, 30*b* are intended to be inserted into the cavity 16 whether or not a conductor bar 20 is present in the supply accessory; therefore, a casual user would not associate this seemingly purely mechanical interaction between the extendible members and the cavity 16 with any security procedure.

Further as shown in FIG. 2, the conductor bar 20 can be obscured on both sides thereof, so that the presence and function thereof would not be apparent even if the supply accessory 10 were dismantled. As shown in FIG. 2, a cover plate 21 can be provided on the inward-facing surface of conductor bar 20, in an inconspicuous manner so that the structure and function of conductor bar 20 would be obscured even if the outer housing 12 were removed. Indeed, conductor bar 20 could be in the form of a foil-like conductive trace which is sandwiched between two very thin plastic portions forming the outer housing 12.

While the invention has been described with reference to the structure disclosed, it is not confined to the details set forth, but is intended to cover such modifications or changes as may come within the scope of the following claims.

We claim:

1. A supply accessory installable in a printing apparatus, comprising:

an outer housing;

a tank, disposed at least partially within the outer housing, adapted to retain a supply of print material;

a first cavity and a second cavity, defined in an outer surface of the outer housing;

a first conductive surface disposed within the first cavity;

a second conductive surface disposed within the second cavity; and a conductor disposed inside the outer housing between the first conductive surface and the second conductive surface.

2. The supply accessory of claim 1, further comprising a cover plate disposed on an inner surface of the outer housing, the conductor being sandwiched between the outer housing and the cover plate.

3. The supply accessory of claim 1, the conductor being of a predetermined nonzero resistance.

4. A supply accessory installable in a printing apparatus, comprising:

an outer housing;

a tank, disposed at least partially within the outer housing, adapted to retain a supply of print material;

a first conductive surface disposed on the housing;

a second conductive surface disposed on the housing; and a conductor operatively disposed between the first conductive surface and the second conductive surface, the conductor being not exposed on an outer surface of the outer housing.

5. The supply accessory of claim 4, further comprising:

a first cavity and a a second cavity, defined in an outer surface of the outer housing, the first conductive surface disposed within the first cavity, and the second conductive surface disposed within the second cavity; and a conductor disposed between the first conductive surface and the second conductive surface.

6. The supply accessory of claim 5, the conductor being of a predetermined nonzero resistance.

7. The supply accessory of claim 5, further comprising a cover plate disposed on an inner surface of the outer housing, the conductor being sandwiched between the outer housing and the cover plate.

8. A printing apparatus, comprising:

a supply accessory including an outer housing;

a tank, disposed at least partially within the outer housing, adapted to retain a supply of print material;

a first cavity and a a second cavity, defined in an outer surface of the outer housing;

a first conductive surface disposed within the first cavity;

a second conductive surface disposed within the second cavity; and a conductor disposed inside the outer housing between the first conductive surface and the second conductive surface; and an extendible member positioned within the printing apparatus to extend into the cavity defined in the outer surface of the outer housing when the supply accessory is installed.

9. The printing apparatus of claim 8, wherein the extendible member is springably mounted within the printing apparatus.

10. The printing apparatus of claim 9, the extendible member urging the supply accessory into a predetermined position within the printing apparatus.

11. The printing apparatus of claim 8, the extendible member including a conductive contact thereon for contacting the first conductive surface.

12. The printing apparatus of claim 8, further comprising a switch associated with the extendible member, a status of the switch being dependent on an extent which the extendible member is extended into the cavity.

13. The printing apparatus of claim 12, the extendible member including a conductive contact thereon for contacting the first conductive surface, and wherein the switch is operatively associated with the conductive contact.

14. The printing apparatus of claim 8, further comprising a contact positioned within the printing apparatus to contact the second conductive surface when the supply accessory is installed.

15. The printing apparatus of claim 8, wherein the conductor is disposed inside the outer housing of the supply accessory.

16. The printing apparatus of claim 8, further comprising means for causing a current to pass through the conductor.

17. The printing apparatus of claim 8, further comprising control means for affecting operation of the printing apparatus in response to whether current is able to pass between the first conductive surface and the second conductive surface.

18. The printing apparatus of claim 17, the control means affecting operation of the printing apparatus in response to detecting a predetermined nonzero resistance of the conductor.

* * * * *